US006409931B1

(12) United States Patent
Shimomura et al.

(10) Patent No.: US 6,409,931 B1
(45) Date of Patent: Jun. 25, 2002

(54) METHOD OF PRODUCING INK JET RECORDING HEAD AND INK JET RECORDING HEAD

(75) Inventors: Akihiko Shimomura, Yokohama; Susumu Kadokura, Iwai; Hiroto Matsuda, Ebina; Isao Imamura, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/245,109

(22) Filed: Jan. 25, 1999

(30) Foreign Application Priority Data

Jan. 26, 1998 (JP) ..... 10-012861

(51) Int. Cl.[7] ..... B41J 2/04; B41J 2/16; G01D 15/18

(52) U.S. Cl. ..... 216/27; 438/21; 347/45; 205/127

(58) Field of Search ..... 216/27, 58; 205/127, 205/118, 123; 347/45; 438/21

(56) References Cited

U.S. PATENT DOCUMENTS

| | | | | |
|---|---|---|---|---|
| 4,438,191 A | * | 3/1984 | Cloutier et al. | 430/324 |
| 5,208,606 A | | 5/1993 | Klein et al. | 346/1.1 |
| 5,451,992 A | | 9/1995 | Shimomura et al. | 347/45 |
| 5,482,660 A | * | 1/1996 | Yamamoto et al. | 264/474 |
| 5,598,193 A | | 1/1997 | Halko et al. | 347/45 |
| 5,770,271 A | | 6/1998 | Imamura | 427/412.1 |

FOREIGN PATENT DOCUMENTS

| | | | |
|---|---|---|---|
| GB | 2283208 A | 5/1995 | B41J/2/16 |
| JP | 61-291148 | 12/1986 | B41J/3/04 |
| JP | 62-253457 | 11/1987 | B41J/3/04 |
| JP | 4-10940 | 1/1992 | B41J/2/05 |
| JP | 4-10941 | 1/1992 | B41J/2/05 |
| JP | 4-10942 | 1/1992 | B41J/2/05 |
| JP | 5-330060 | 12/1993 | B41J/2/135 |
| JP | 6-286149 | 10/1994 | B41J/2/16 |
| JP | 7-138763 | 5/1995 | B41J/2/135 |
| JP | 61-154947 | 7/1996 | B41J/3/04 |
| JP | 9-76515 | 3/1997 | B41J/2/16 |
| WO | WO 97/27059 | 7/1997 | B41J/2/135 |

* cited by examiner

*Primary Examiner*—Frankie L. Stinson
*Assistant Examiner*—Shamim Ahmed
(74) *Attorney, Agent, or Firm*—Fitzpatrick, Cella, Harper & Scinto

(57) ABSTRACT

A method of producing an ink jet recording head, in which a discharge port surface provided with a discharge port, through which ink is discharged, is provided comprises a conductive treatment step of carrying out a conductive treatment of the discharge port surface in a state where a material is present in the portion of the discharge port, a removing step of removing the material to open the discharge port, and an electrolytic deposition step of electrolytically deposit a water repellent material in the conduction-treated region of the discharge port surface.

33 Claims, 5 Drawing Sheets

FIG. 1A1
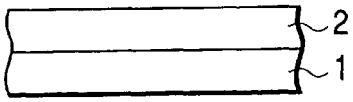
FIG. 1A2
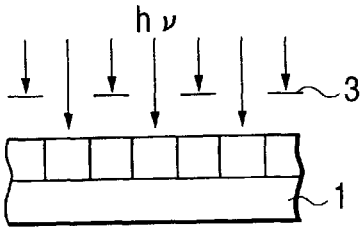
FIG. 1A3
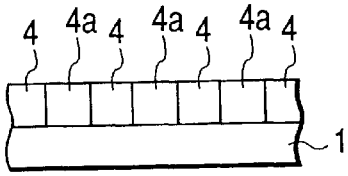
FIG. 1B
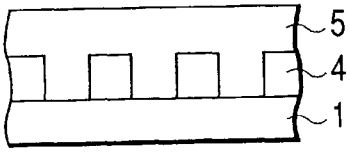
FIG. 1C1
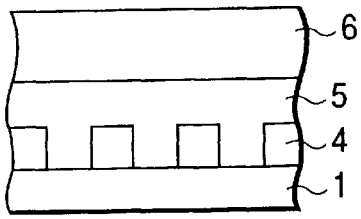
FIG. 1C2
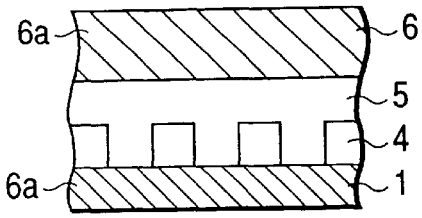
FIG. 1C3
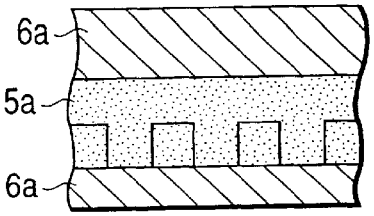
FIG. 1D
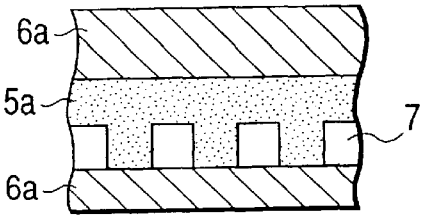
FIG. 1E
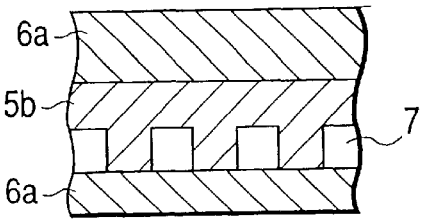

METHOD OF PRODUCING INK JET RECORDING HEAD AND INK JET RECORDING HEAD

BACKGROUND OF THE INVENTION

1. Field of the Invention

The present invention relates to a method of producing an ink jet recording head that discharges ink to record, and an ink jet recording head produced by the method.

2. Related Background Art

An ink jet recording head generally includes a plurality of ink flow paths, each of which is communicated with each of a plurality of minute ink discharge ports, and an ink chamber commonly communicated with the plurality of ink flow paths. The plurality of ink flow paths and the common ink chamber are integrally referred to as an ink path. Energy generators, which generate energy which is utilized to discharge ink from the discharge port, are usually provided so as to correspond to the ink paths respectively. A typical example of the energy generators involves an electrothermal converting element which generates thermal energy as energy which is utilized to discharge ink, or a piezoelectric device.

As a method of producing such ink jet recording head, for example, Japanese Laid-Open patent Application Nos. 61-154947 and 62-253457 describe a method thereof comprising the steps of forming an ink path pattern on a substrate with a soluble resin, setting the pattern with an epoxy resin or the like to set the epoxy resin, and dissolution-removing the pattern of the soluble resin after cutting the substrate. This method is mainly described as a method of producing a type of ink jet recording head in which an ink discharge direction is substantially a vertical to a direction where ink is supplied onto an electrothermal converting element.

To obtain a high-definition recording image by an ink jet recording head, it is preferable that small droplets of ink, which are discharged from the discharge port are stably discharged at the same volume and discharge speed from the respective discharge ports. To realize such a stable ink discharge, each of Japanese Laid-Open patent Application Nos. 4-10940, 4-10941 and 4-10942 discloses a discharge method comprising the steps of applying drive signals to an electrothermal converting element in response to recording information, forming bubbles in ink by imparting thermal energy, which imparts rapid increase in temperature so as to exceed a nuclear boiling temperature of ink, to ink with the electrothermal converting element, and discharging ink as droplets by allowing the bubbles to communicate with the outside air. To realize such discharge method, it is preferable that the distance between the discharge port or orifice and the electrothermal converting element or heater is short as an ink jet recording head. The distance therebetween is hereinafter referred to as "OH distance". In the above-mentioned discharge method, the OH distance substantially determines the discharge volume of the droplets of ink. Thus, it is important that the OH distance can be accurately and reproducibly formed.

Japanese Laid-Open patent Application No. 6-286149 discloses a method of producing an ink jet recording head which can shorten such OH distance and accurately produce it. A typical example of the production method described in this Application is carried out as follows in short. First, patterns of ink paths are formed on a substrate in lamination with soluble resin, a desired number of energy generators being arranged on the substrate. Then, by solvent-coating a mixture of a solvent and a coating resin melted in the solvent on the soluble resin layer, a coating resin layer, which will become the wall of an ink path, is formed on soluble resin layer. The coating resin contains solid epoxy resin at ordinary temperatures. Then, discharge ports are formed in the coating resin layer positioned on the energy generators, and ink paths are formed by dissolution-removing the soluble resin layer.

In the method of producing the ink jet recording head, ink droplets can be adhered to the periphery of the discharge port after the repetition of ink discharge or the like. The adhesion of the droplets can cause deviation between the discharge directions of droplets discharged from the discharge port by the degree of the adhesion thereof and cause troubles to high-definition and accurate recording. To prevent the adhesion of ink to the portion near the discharge port, which adhesion is the main reason of the deviation of the discharge direction, a method of carrying out a water repellent treatment of the discharge port region where the discharge port is formed is known.

The water repellent treatment for the ink jet recording head has been carried out by steps of transferring a water repellent applied to a flexible member of a silicone rubber or the like, to the discharge port region of the ink jet recording head produced by the above-mentioned method, and drying or setting the obtained structure. However, since, in the water repellent treatment, the water repellent treatment agent is also transferred to the opening region of the discharge port, it was difficult to prevent penetration of a small part of the water repellent into the discharge port. To obtain high quality level and high-definition recording images by the use of the ink jet recording head, each size of ink droplets discharged from the ink discharge port have been recently become very small. Therefore, the entrance of the water repellent into the discharge port, even if to the small extent, can effect on the discharge directions of the droplets.

SUMMARY OF THE INVENTION

One object of the present invention is to provide a method of producing an ink jet recording head which can discharge ink straight in aimed directions from a discharge port thereby to stably make high quality level and high-definition recording for a long term, and an ink jet recording head produced by the production method.

Another object of the present invention is to provide a method of producing an ink jet recording head in which a water-repellent material is not penetrated into the discharge port, and an ink jet recording head produced by the production method.

Still another object of the present invention is to provide a method of producing an ink jet recording head, which can correctly form a water repellent film having a thickness which has sufficient endurance to external causes such as paper jamming, paper rubbing with powder and the like, in a desired region, and an ink jet recording head produced by the production method.

Still another object of the present invention is to provide a method of producing an ink jet recording head, in which a discharge port surface provided with a discharge port, through which ink is discharged, is provided comprising:

- a conductive treatment step of carrying out a conductive treatment of the discharge port surface in a state where a material is present in the portion of the discharge port;
- a removing step of removing said material to open the discharge port; and
- an electrolytic deposition step of electrolytically deposit a waiter repellent material in the conduction-treated region of the discharge port surface.

Still another object of the present invention is to provide a method of producing an ink jet recording head, in which a discharge port surface provided with a discharge port, through which ink is discharged, is provided comprising:

an unfinished-treatment step of treating the discharge port surface to the middle stage of a conductive treatment of the discharge port surface in a state where a material is present in the portion of the discharge port;

a removing step of removing said material to open the discharge port;

a treatment finishing step of finishing the conductive treatment; and an electrolytic deposition step of electrolytically deposit a water repellent material in the conduction-treated region of the discharge port surface.

Still another object of the present invention is to provide an ink jet recording head produced by such methods of producing an ink jet recording head.

According to the present invention, prior to opening the discharge port a conductive treatment of the discharge port surface is carried out, or the conductive treatment is carried out in the middle stage. Consequently, when a water repellent coating material is coated with an electrolytic deposition process, only the discharge port surface other than the discharge port is water-repellent treated, whereby no water repellent coating materials is penetrated into the discharge port. Therefore, even if each size of ink droplets which are discharged is small, an ink jet recording head in which no deviation of the discharge direction occur can be produced. Further, according to the present invention, a water repellent film having a thickness which has sufficient endurance to the external causes, such as paper jamming, paper rubbing with powder and the like, can be correctly formed in a desired region.

BRIEF DESCRIPTION OF THE DRAWINGS

FIGS. 1A1, 1A2, 1A3, 1B, 1C1, 1C2, 1C3, 1D and 1E are schematic front views showing a production method of an ink jet recording head according to Example 1 of the present invention in the production step order;

DETAILED DESCRIPTION OF THE PREFERRED EMBODIMENT

Figure 2A:
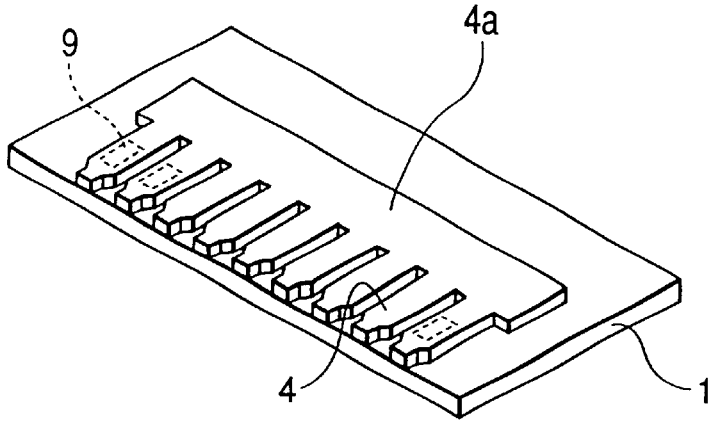
FIGS. 2A, 2B, 2C, 2D and 2E are schematic perspective views showing the production method of the ink jet recording head according to Example 1 of present invention in the production step order.

A method of producing an ink jet recording head according to the present invention can be applied to any methods, in which a nozzle hole which is a discharge port is opened by removing a portion of the discharge port from a member which is provide with a discharge port.

In the present invention, the time when a portion of a discharge port is removed to open the discharge port is the time when a conductive treatment of the discharge port surface, where a discharge port is provided has been finished, or the time when the conductive treatment is in the middle stage. The term "finish of a conductive treatment" means that a conduction treated surface exhibits sufficient conductive properties to carry out an electrolytic deposition coating. Further, the term "middle stage of the conductive treatment" means a stage where even if a conductive treatment is still carried out on a non-conduction treated surface in the middle stage of the conductive treatment, the surface does not exhibit sufficient conductive properties to carry out an electrolytic deposition coating. Subsequent conductive treatment is subjected to a conduction treated surface to the middle stage of the conductive treatment, whereby the conductive treatment is finished. Even if the remaining conductive treatment steps are carried out after a resolve material, for example, resin is dissolution-removed in the middle stage of the conductive treatment thereby forming a discharge port, the inside of the discharge port is not conduction-treated and water repellent treatment is not carried out.

For example, when a Sn treatment (seeding), a Pd treatment (catalytic treatment) and an electroless plating are carried out in order of the steps after the surface to be treated has been etched as a preliminary treatment, the dissolution-removal of a soluble resin material is preferably carried out after the Sn treatment. Further, in a case of a conductive treatment, where the Sn treatment is not required, the dissolution-removal of a soluble resin material is preferably carried out after the Pd treatment. When the conductive treatment is finished, a comparatively thick water metallic film is also formed on a resin material to be dissolution-removed. Therefore, preferably, the dissolution-removal of a soluble resin material in the middle stage of the conductive treatment is easier and the subsequent electrolytic deposition coating properties are better.

Water repellent materials used in the present invention can be electrolytic-deposition coated, and as the materials, well known materials such as acrylic silicone type, acrylic fluorine type, epoxy fluorine type etc., can be used. As such water repellent coating, HANNY CHEMICALS CO., LTD. can be involved.

In the present invention, it is possible to thickly form a water repellent coating on a discharge port surface. For example, a water repellent coating having a thickness of 0.5 $\mu$m or more, which is sufficiently durable to actually use, can be formed thereon.

The present invention can be used as a method of producing an ink jet recording head in which a direction of discharging ink from a discharge port is substantially parallel to an ink supply direction where ink is supplied used as produce a method of producing an ink jet recording head in which a direction of discharging ink from a discharge port is substantially vertical to an ink supply direction where ink is supplied through an energy generator in the ink path.

Figure 2B:
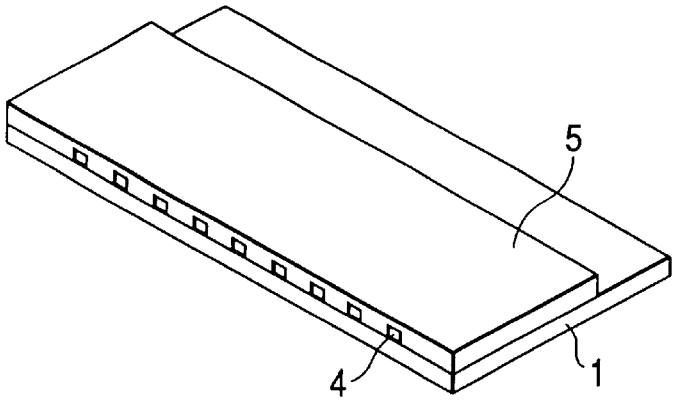
Figure 2C:
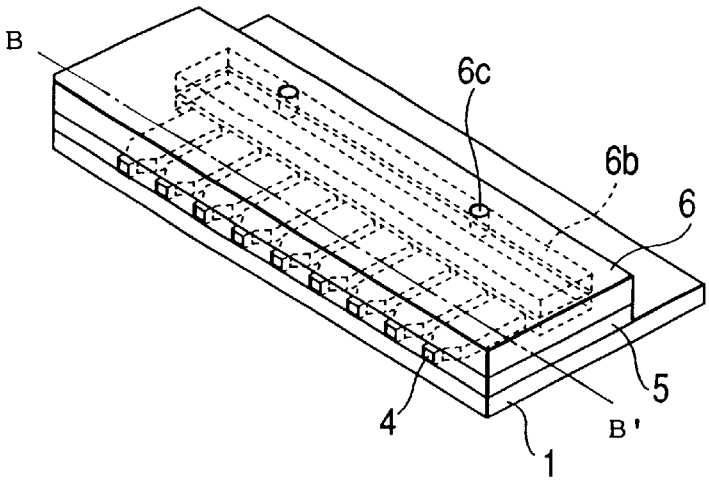
Figure 2D:
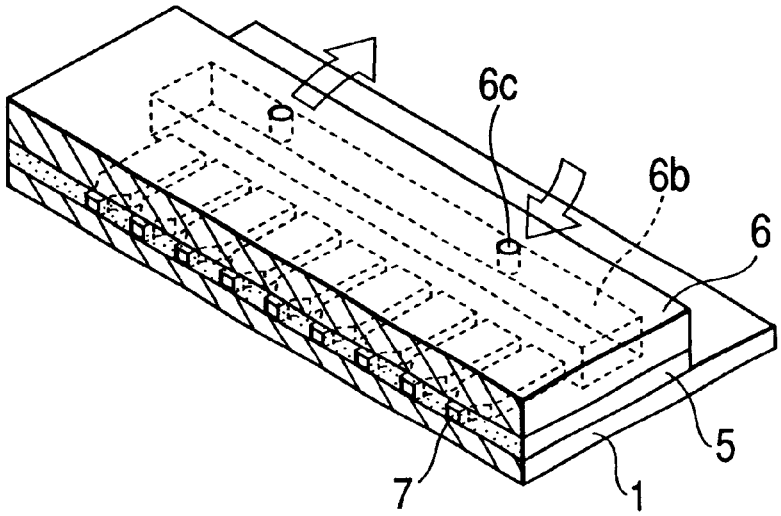
Figure 2E:
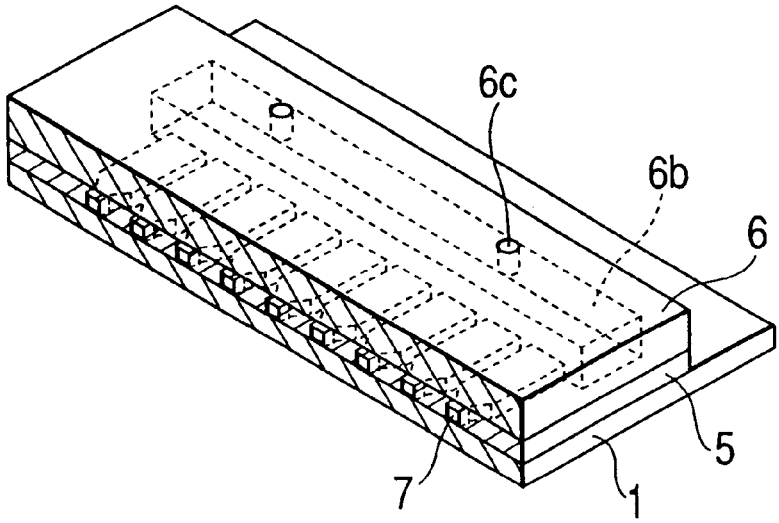

The ink jet recording head in which the ink discharge direction and the ink supply direction are substantially parallel to each other typically has a configuration as shown in FIG. 2E. If, in this case, a soluble resin material is composed of a photosensitive resin, such as a resist formed on a substrate by the exposing and developing processes, the formation of the ink path can be easily made, as described in Japanese Laid-Open patent Application No. 61-154947. The photosensitive resin may be either a positive type or a negative type. In a case where the photosensitive resin is formed as an ink path pattern, any resin may be used if the resin can be dissolution-removed with a solvent, which is appropriately determined by consideration of solubility differences between this soluble resin and the insoluble resin covering the pattern. If the soluble photosensitive resin is a positive type resin, the formation of the ink path can be further easily made. As a solvent which is used as an eluant, an organic solvent, an alkaline water solution, and the like can be used.

Alternatively, instead of the use of such photosensitive resin, a soluble resin material is formed on a substrate and the formed soluble resin material can be etched to form a pattern. The etching is usually carried out by using a suitable resist. For example, as the etching process, dry etching using a Si type resist such as a FH-SP produced by FUJIFILM OLIN CO., LTD., or the like can be included.

Further, the entire wall surfaces for an ink path may be formed of insoluble material such as an insoluble resin. Alternatively, a part of the wall surfaces may be formed with a rigid body, such as a substrate or the like, and the remaining portion thereof may be formed with an insoluble resin or the like.

Figure 3A:
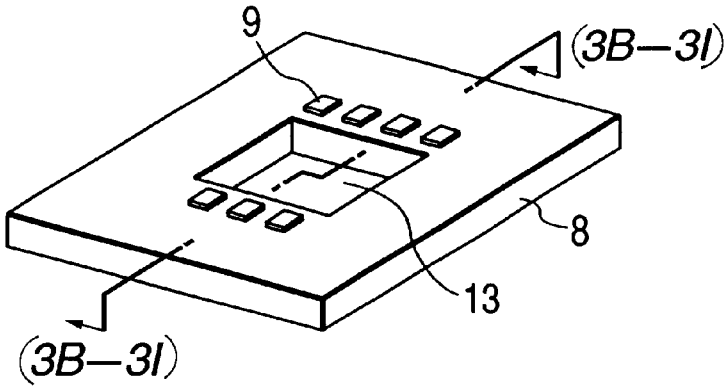
FIG. 3A is a schematic perspective view explaining a production method of an ink jet recording head according to Example 2 of the present invention.
Figure 3B:
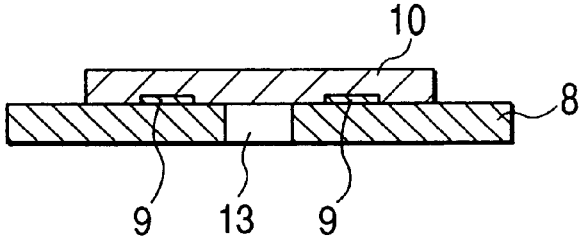
FIGS. 3B, 3C, 3D, 3E, 3F, 3G, 3H and 3I are schematic cross-sectional views taken along dot-dash line (3B–3I)—(3B–3I) of FIG. 3A, showing the production method thereof in a production step order.
Figure 3C:
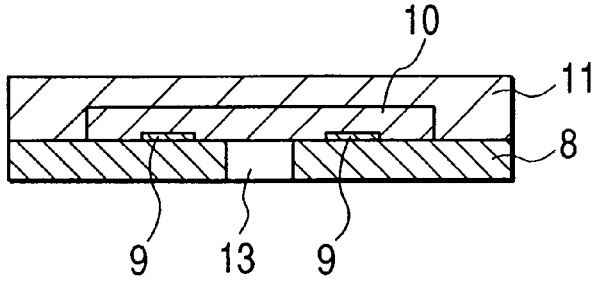
Figure 3D:
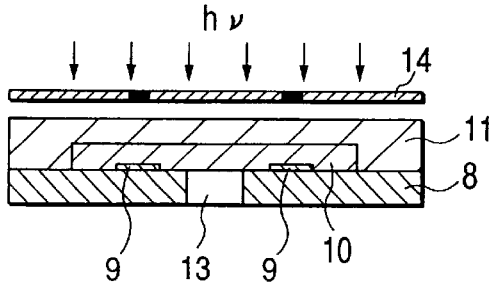
Figure 3E:
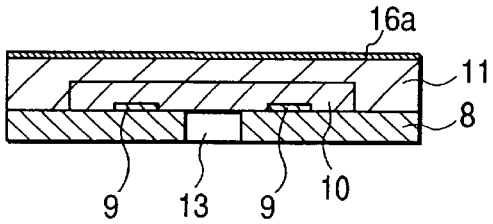
Figure 3F:
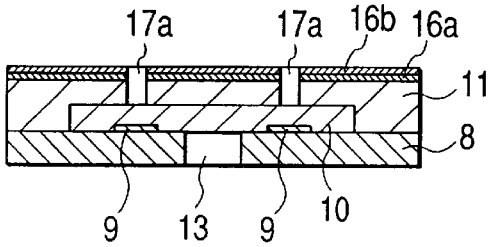
Figure 3G:
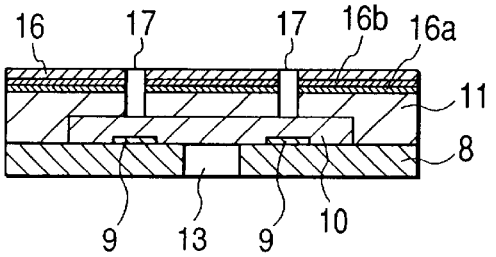
Figure 3H:
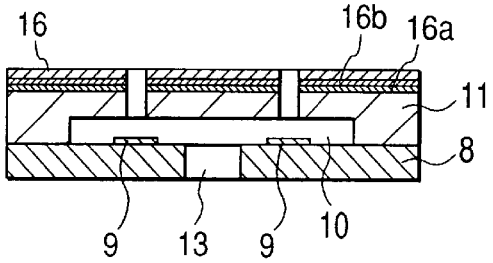

On the other hand, an ink jet recording head in which the ink discharge direction is substantially vertical to the ink supply direction onto the energy generator has a typical configuration shown in FIG. 3H. In this case, the ink jet recording head uses a photosensitive resin as a member, which is provided with a discharge port, to form a resist layer. After that, the resist layer is exposed so that a portion which will become a discharge port is caused to be soluble and tile periphery portion of the discharge port is caused to be insoluble. Then, the discharge port surface is conduction-treated or a part of the discharge port is dissolution-removed in the middle stage of the conductive-treatment, whereby a discharge port can be formed.

The photosensitive resin may be either a positive type or a negative type. As the resin in a portion which will become a discharge port, a resin which is soluble after exposure, can be used, and as the resin in the periphery of the discharge port, a resin, which is insoluble after exposure, can be used. As such photosensitive resin, a photosensitive resin and the like containing an epoxy resin as a resin component can be involved, as described in for example, Japanese Laid-Open patent Application No. 6-286149. A solvent which is used for dissolution can be appropriately determined by consideration of solubility differences between a soluble resin and an insoluble resin. As the solvent, for example, an organic solvent, an alkaline water solution, and the like can be used.

Instead of the use of the above-mentioned photosensitive resin, after a member which is provided with a discharge port is formed on a substrate which was subjected to a required processing to form an ink path, the member may be etched to form a discharge port after conduction-treatment of the discharge port surface or during the middle stage of the treatment. The etching is usually carried out by using a suitable resist. For example, as the etching process, dry etching using an Si type resist such as a FH-SP produced by FUJIFILM OLIN CO., LTD., or the like can be included.

The method of producing the ink jet recording head according to the present invention can be efficiently used when a full-line type recording head provided with a plurality of discharge ports in the entire width of a recording paper is produced, and when a color recording head integrally combined with plurality of recording heads is produced.

The present invention will be concretely described by the following Examples, but not limited thereto.

EXAMPLE 1

FIGS. 1A1, 1A2, 1A3, 1B, 1C1, 1C2, 1C3, 1D and 1E are schematic front views (cross-sectional views) showing a production method of an ink jet recording head according to Example 1 of the present invention in the production step order. FIGS. 2A to 2E are schematic perspective views showing the production method of the ink jet recording head according to Example 1 of present invention in the production step order.

As shown in FIG. 1A1, on an aluminum substrate 1, on which electrothermal converting elements 9 were formed as energy generators, was provided a 30 $\mu$m thick positive type photo-resist (AZ-4903 produced by Hoechst Japan Limited), thereby forming a resist layer 2 by prebaking at 90° C., for 40 min. in an oven.

Then, as shown in FIG. 1A2, a pattern exposure was subjected to the resist layer 2 through a mask pattern, at an exposure quantity of 800 mJ/cm$^2$. After that, the exposed structure was developed with 0.75 wt % aqueous sodium hydroxide and subjected to a rinse treatment with ion exchange water. As the result, as shown in FIGS. 1A3 and 2A, resist patterns 4 having portions corresponding to a plurality of ink paths and resist patterns 4*a* having portions corresponding to a common ink chamber were obtained.

Then, as shown in FIGS. 1B and 2B; a low-temperature curing type epoxy resin composition was applied onto the resist patterns 4 and 4*a* with a microdispensor. The epoxy resin composition is a material 5 which is used for forming walls of ink paths.

Then, as shown in FIGS. 1C1 and 2C, the obtained structure was covered with a coated aluminum cover plate 6. The reference numeral 6*b* denotes a cavity portion formed in the cover plate 6 so as to correspond to the common ink chamber, and the reference numeral 6*c* denotes a supply port for supplying ink to the common ink chamber. Then, the epoxy resin composition which will be the path wall forming member 5 was cured at 80° C. for 2 hrs. The epoxy resin composition was prepared by mixing the following resin and the like.

Epikote 828 (85 parts) produced by YUKA SHELL EPOXY K.K.;

ARALDITE DYO 22 (10 parts) produced by CHIBA-BEIGY Ltd.;

Epoxy type silane KBM 403 (5 parts) produced by The Shin-Etsu Chemical Co., Ltd.; and Microcapsuled curing agent Nova Cure HX-3722 (60 parts) produced by ASAHI CHEMICAL Industry Co., Ltd.

Then, to form a discharge port surface a diamond chip saw produced by Oriental Dia Co., Ltd. is attached to an automatic slicer DLS-61/50 RMS produced by Disco Corp. and the structure shown in FIG. 2C was cut along the dot-dash line B–B'. To remove the exposed surface oxide films of the cut ends of the aluminum substrate 1 and aluminum cover plate 6, the cut ends were subjected to degreasing treatment at 50° C. for 5 min. by the use of TOP ALCLEAN 161 produced by OKUNO CHEMICAL INDUCTRIES CO., LTD. and to etching treatment at 45° C. for 1.5 min. by the use of TOP ALSOFT 108 produced by OKUNO CHEMICAL INDUCTRIES CO., LTD. Subsequently, the cut ends of the substrate 1 and cover plate 6 were subjected to zincating treatment at an ordinary temperature for 40 sec. by the use of SUBSTAR ZN-10 produced by OKUNO CHEMICAL INDUSRIES Co., Ltd. and to electroless plating treatment at 90° C. for 10 min. by the use of TOP NICORON TOM produced by OKUNO CHEMICAL INDUCTRIES CO,., LTD. thereby forming a plated layer 6*a* (FIG. 1C2).

After that, the cut end of the path wall forming member 5 composed of epoxy resin was subjected to catalytic action at 40° C. for 3 min. by the use of OPC-50 inducer produced by OKUNO CHEMICAL INDUCTRIES CO., LTD. and to activation treatment at an ordinary temperature for 3 min. by the use of C-150 CRYSTALER MU produced by OKUNO CHEMICAL INDUCTRIES CO., LTD. thereby forming an activated surface 5*a* (FIG. 1C3). In this example, the catalytic action and activation treatment correspond to treatment to the middle stage of the conductive treatment.

Then, resist patterns 4 and 4*a* were removed by ethylcellosolve as shown by arrows in FIG. 2D. As the result, ink paths 7 were formed and at the same time portions corresponding to discharge ports in the activated surface 5*a* were removed, as shown in FIGS. 1D and 2D.

After that, electroless plating treatment was made at 65° C. for 2 min. by the use of TOP CHEMIALLOY B-1 produced by OKUNO CHEMICAL INDUCTRIES CO., LTD. so that nickel-boron alloy was formed on the activated surface 5*a* of the path wall forming member 5 composed of epoxy resin. As the result, the conductive treatment of the epoxy resin was completed.

Then, after electrolytic deposition of 3 μm thick coating HT-8 produced by HONNY CHEMICALS CO., LTD. on the conduction treated surface of the epoxy resin, curing treatment was made at 120° C. for 2 hr., whereby water repellent treatment was completed. In such manner, a water repellent film 5*b* was formed as shown in FIGS. 1E and 2E. In this ink jet recording head produced by Example 1, water repellent coating is not penetrated into the discharge port. Thus, the ink jet recording head has improved properties for the discharge port.

EXAMPLE 2

FIG. 3A is a schematic perspective view explaining a production method of an ink jet recording head according to Example 2 of the present invention and FIGS. 3B to 3I are schematic cross-sectional views taken along dot-dash line (3B–3I)—(3B–3I) of FIG. 3A, showing the production method thereof in a production step order.

First, a blast mask was provided on a flat plate shaped silicon substrate 8 on which electrothermal converting elements 9, were formed as energy generators and a through hole 13 for supplying ink was formed by a sandblasting processing (FIG. 3A). Each of the electrothermal converting elements 9 is a heating resistor composed of material of $HfB_2$.

Then, a layer of polymethylisopropenyl ketone ODUR-1010 produced by Tokyo Ohka Kogyo Co., Ltd.) was applied onto the base material of polyethylene terephthalate (PET) and the obtained structure was dried. Thus obtained dry film was lamination-transferred to the silicon substrate 8, so that a soluble resin layer composed of polymethylisoprophenyl ketone was formed on the silicon substrate 8. In this case, the ODUR-1010 has a low viscosity and is not formed in a thick film. Thus it was used by thickening it.

Then, after the soluble resin layer was prebaked at 120° C. for 20 min., exposure was performed in the pattern of ink paths for 1.5 min. by the use of a maskaligner PLA 520 (cold mirror CM 290) produced by Canon Inc. A spraying development was performed with 1% caustic soda thereby forming a resist pattern 10 corresponding to the ink paths (FIG. 3B). The resist pattern was formed with soluble resin. The film thickness of developed resist pattern 10 was 10 μm.

Methylisobutyl ketone/diglym mixed solvent in which photosensitive resin composition was melted was spin coated so that it covers the resist pattern 10, thereby forming a photosensitive coated resist layer 11 as shown in FIG. 3C. The film thickness of the photosensitive coated resist layer 11 on the resist pattern 10 was 10 μm. The used photosensitive resin compositions for forming the coated resin layer were as follows.

Epoxy resin EHPE-3150 (Trade name) produced by Daicel Chemical Industries Ltd.;

Diol 1,4-HFAB (Trade name) produced by Central Glass Co., Ltd.; Silane coupling agent A-187 (Trade name) produced by NIPPON CUNICAR CO., LTD.; and Photopolymerization initiator ADEKA OPTOMER SP-170 (Trade name) produced by ASAHI DENKA KOGYO K.K.

Then, a patterning exposure for forming ink discharge ports was performed through a mask 14 by the use of a mask aligner PLA 520 (CM 250) produced by Canon Inc. as shown in FIG. 3D. By this exposure, the exposed portions became insoluble and the non-exposed portions were left in soluble state. The exposure was performed for 10 sec. and the postbaking was performed at 60° C. for 30 min.

Subsequently, the photosensitive coated resin layer 11 was etched with chrome acid solution of 420 g/l at 55° C. for 1 min. and treated with TMP sensitizer produced by OKUNO CHEMICAL INDUCTRIES CO., LTD. at room temperature for 3 min. to cause Tin ions to adsorb to the photosensitive coated resin layer 11. After that, as shown in FIG. 3E, the obtained structure was treated with TMP activator produced by OKUNO CHEMICAL INDUCTRIES CO., LTD. to form a Pb catalytic metallic layer 16*a*.

Then, development of the photosensitive coated resin layer 11 was performed with methylisobutyl ketone to form nozzle portions 17*a* communicated with the respective ink discharge ports, as shown in FIG. 3F. In this Example a nozzle pattern having a diameter of 26 μm was formed. Subsequently, the obtained structure was electroless deposition treated with TMP chemical nickel produced by OKUNO CHEMICAL INDUCTRIES CO., LTD. at 45° C. for 3 min., to form a plated layer 16*a*, whereby conductive treatment of the coated resin layer 11 was completed.

To thus conduction treated head was applied coating HT-8 produced by HONNY CHEMICALS CO., LTD. 100° C. for 1 hr. to form electrolytic deposition coated film 16, resulting in completion of water repellent treatment.

At this stage, the resist pattern 10 is still left. Accordingly, the resist pattern was again exposed by the use of mask aligner PLA 520 (CM 290) produced by Canon Inc. for 2 min., and immersed into methyl lactate while imparting ultrasonic wave thereto, so that the remaining resist pattern 10 was dissolution removed as shown in FIG. 3H. Then thus formed structure was heated at 150° C. for 1 hr to fully cure the photosensitive coated material layer 11 and the electrolytic deposition coated film 16.

Figure 3I:
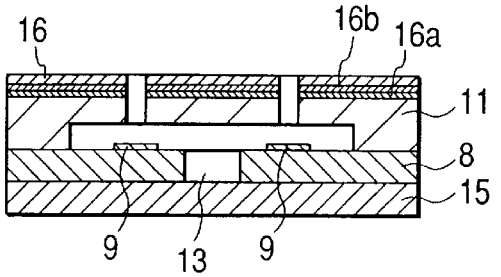

Finally, as shown in FIG. 3I, an ink supply member 15 was adhered to an ink supply opening or port area so that an ink jet recording head of this Example was completed. In thus produced ink jet recording head, the water repellent coating is not penetrated into the discharge ports 17 and has improved discharge properties.

What is claimed is:

1. A method of producing an ink jet recording head, in which a discharge port surface provided with a discharge port, through which ink is discharged, is provided comprising:

a conductive treatment step of carrying out a conductive treatment of said discharge port surface in a state where a material is present in a portion of said discharge port;

a removing step of removing said material to open said discharge port; and an electrolytic deposition step of electrolytically depositing a water repellent material in the conduction-treated region of said discharge port surface.

2. A method of producing an ink jet recording head according to claim 1, wherein said material in said removal step is composed of soluble resin.

3. A method of producing an ink jet recording head according to claim 2, wherein said soluble resin includes epoxy resin.

4. A method of producing an ink jet recording head according to claim 2, wherein said soluble resin is a photosensitive resin.

5. A method of producing an ink jet recording head according to claim 4, wherein said photosensitive resin is a positive type photosensitive resist.

6. A method of producing an ink jet recording head according to claim 1, wherein the removal of said material in said removal step is carried out by etching.

7. A method of producing an ink jet recording head according to claim 6, wherein said etching is dry etching.

8. A method of producing an ink jet recording head according to claim 1, further comprising a step of forming said discharge port surface by cutting in a state where said material is present at a portion of said discharge port, prior to said conductive treatment step.

9. An ink jet recording head produced by the method of producing an ink jet recording head according to claim 1, wherein said water repellent material is not penetrated into said discharge port.

10. An ink jet recording head according to claim 9, wherein an energy generator, which generates energy, which is used for discharging ink from said discharge port, is provided so as to correspond to the ink path communicated with said discharge port.

11. An ink jet recording head according to claim 10, wherein a direction of discharging ink from said discharge port and an ink supply direction where the ink is supplied onto said energy generator in said ink path are substantially parallel to each other.

12. An ink jet recording head according to claim 10, wherein a direction of discharging ink from said discharge port and an ink supply direction where the ink is supplied onto said energy generator in said ink path are substantially vertical to each other.

13. An ink jet recording head according to claim 10, wherein said energy generator is an electrothermal converting element which generates thermal energy as energy.

14. An ink jet recording head according to claim 10, wherein said energy generator is a piezoelectric device.

15. An ink jet recording head according to claim 9, wherein it is a full line type ink jet recording head in which a plurality of said discharge ports are provided in the entire width of a recording region where recording is performed.

16. An ink jet recording head according to claim 9, wherein color recording is possible.

17. A method of producing an ink jet recording head, in which a discharge port surface provided with a discharge port, through which ink is discharged, is provided comprising:

an unfinished-treatment step of treating said discharge port surface to the middle stage of a conductive treatment of said discharge port surface in a state where a material is present in a portion of said discharge port;

a removing step of removing said material to open said discharge port;

a treatment finishing step of finishing said conductive treatment; and an electrolytic deposition step of electrolytically depositing a water repelling material in the conduction-treated region of said discharge port surface.

18. A method of producing an ink jet recording head according to claim 17, wherein said material in said removal step is composed of soluble resin.

19. A method of producing an ink jet recording head according to claim 18, wherein said soluble resin includes epoxy resin.

20. A method of producing an ink jet recording head according to claim 18, wherein said soluble resin is a photosensitive resin.

21. A method of producing an ink jet recording head according to claim 20, wherein said photosensitive resin is a positive type photosensitive resist.

22. A method of producing an ink jet recording head according to claim 17, wherein the treatment to the middle stage of said conductive treatment in said unfinished-treatment step is a preliminary treatment of said conductive treatment in said treatment finishing step.

23. A method of producing an ink jet recording head according to claim 17, wherein the removal of said material in said removal step is carried out by etching.

24. A method of producing an ink jet recording head according to claim 23, wherein said etching is dry etching.

25. A method of producing an ink jet recording head according to claim 17, further comprising a step of forming said discharge port surface by cutting in a state where said material is present at a portion of said discharge port, prior to said conductive treatment step.

26. An ink jet recording head produced by the method of producing an ink jet recording head according to claim 17, wherein said water repellent material is not penetrated into said discharge port.

27. An ink jet recording head according to claim 26, wherein an energy generator, which generates energy, which is used for discharging ink from said discharge port, is provided so as to correspond to the ink path communicated with said discharge port.

28. An ink jet recording head according to claim 27, wherein a direction of discharging ink from said discharge port and an ink supply direction where the ink is supplied onto said energy generator in said ink path are substantially parallel to each other.

29. An ink jet recording head according to claim 27, wherein a direction of discharging ink from said discharge port and an ink supply direction where the ink is supplied onto said energy generator in said ink path are substantially vertical to each other.

30. An ink jet recording head according to claim 27, wherein said energy generator is an electrothermal converting element which generates thermal energy as energy.

31. An ink jet recording head according to claim 27, wherein said energy generator is a piezoelectric device.

32. An ink jet recording head according to claim 17, wherein it is a full line type ink jet recording head in which a plurality of said discharge ports are provided in the entire width of a recording region where recording is performed.

33. An ink jet recording head according to claim 17, wherein color recording is possible.

* * * * *

UNITED STATES PATENT AND TRADEMARK OFFICE

CERTIFICATE OF CORRECTION

PATENT NO. : 6,409,931 B1
DATED : June 25, 2002
INVENTOR(S) : Akihiko Shimomura et al.

It is certified that error appears in the above-identified patent and that said Letters Patent is hereby corrected as shown below:

Title page,
Item [56], References Cited, FOREIGN PATENT DOCUMENTS, "JP 61-154947 7/1996" should read -- JP 61-154947 7/1986 --; and
Item [57], ABSTRACT,
Line 9, "deposit" should read -- depositing --.

Column 2,
Line 32, "become" should read -- made --;
Line 65, "deposit" should read -- depositing --;
Line 66, "waiter repellant" should read -- water-repellant --.

Column 3,
Line 13, "deposit" should read -- depositing --;
Line 26, "materials" should read -- material --;
Line 29, "occur" should read -- occurs --;
Line 44, "present" should read -- the present --;
Line 60, "provide" should read -- provided --; and
Line 65, "provided" should read -- provided, --.

Column 4,
Line 47, "supplied used as" should read -- supplied, and can be used as --; and
Line 48, "produce" should be deleted.

Column 5,
Lines 12 and 14, "surfaces" should read -- surface --; and
Line 26, "tile" should read -- the --.

Column 6,
Line 5, "present" should read -- the present --;
Line 22, "2B;" should read -- 2B, --;
Line 40, "CHIBA-" should read -- CIBA- --;
Line 41, "BEIGY" should read -- GEIGY --;
Lines 54, 57 and 63, "INDUCTRIES" should read -- INDUSTRIES --; and
Line 61, "INDUSRIES" should read -- INDUSTRIES --.

Column 7,
Lines 2, 5 and 16, "INDUCTRIES" should read -- INDUSTRIES --; and
Line 46, "ODUR-" should read -- (ODUR- --.

UNITED STATES PATENT AND TRADEMARK OFFICE

CERTIFICATE OF CORRECTION

PATENT NO. : 6,409,931 B1
DATED : June 25, 2002
INVENTOR(S) : Akihiko Shimomura et al.

It is certified that error appears in the above-identified patent and that said Letters Patent is hereby corrected as shown below:

Column 8,
Lines 24, 28 and 37, "INDUCTRIES" should read -- INDUSTRIES --.

Signed and Sealed this

Thirteenth Day of May, 2003

JAMES E. ROGAN
*Director of the United States Patent and Trademark Office*